US008726983B2

(12) United States Patent
Khan

(10) Patent No.: US 8,726,983 B2
(45) Date of Patent: May 20, 2014

(54) METHOD AND APPARATUS FOR PERFORMING WIRELINE LOGGING OPERATIONS IN AN UNDER-BALANCED WELL

(75) Inventor: Waqar Khan, Lahore (PK)

(73) Assignee: Schlumberger Technology Corporation, Sugar Land, TX (US)

( * ) Notice: Subject to any disclaimer, the term of this patent is extended or adjusted under 35 U.S.C. 154(b) by 584 days.

(21) Appl. No.: 12/921,874

(22) PCT Filed: Mar. 16, 2009

(86) PCT No.: PCT/EP2009/053083
§ 371 (c)(1),
(2), (4) Date: Nov. 23, 2010

(87) PCT Pub. No.: WO2009/115493
PCT Pub. Date: Sep. 24, 2009

(65) Prior Publication Data

US 2011/0056681 A1 Mar. 10, 2011

(30) Foreign Application Priority Data

Mar. 19, 2008 (EP) ..... 08290261

(51) Int. Cl.
*E21B 19/08* (2006.01)
*E21B 34/02* (2006.01)

(52) U.S. Cl.
USPC ..... 166/77.1; 166/69; 166/75.11; 166/254.2; 251/1.1

(58) Field of Classification Search
USPC ..... 166/69, 77.1, 77.2, 97.5, 254, 75.11, 166/250.01; 251/1.1, 1.2, 1.3
See application file for complete search history.

(56) References Cited

U.S. PATENT DOCUMENTS

| | | | | |
|---|---|---|---|---|
| 4,699,216 | A | 10/1987 | Rankin | |
| 5,435,395 | A * | 7/1995 | Connell | 166/384 |
| 5,871,052 | A | 2/1999 | Benson et al. | |
| 5,927,402 | A * | 7/1999 | Benson et al. | 166/65.1 |
| 5,988,274 | A | 11/1999 | Funk | |
| 2003/0056984 | A1 * | 3/2003 | Smith et al. | 175/40 |
| 2005/0230115 | A1 * | 10/2005 | Rose | 166/301 |
| 2009/0288821 | A1 * | 11/2009 | Eriksen et al. | 166/250.01 |
| 2011/0024187 | A1 * | 2/2011 | Boone et al. | 175/26 |

FOREIGN PATENT DOCUMENTS

| | | |
|---|---|---|
| EP | 553732 | 8/1993 |
| GB | 2404395 | 2/2005 |
| WO | 0060212 | 10/2000 |
| WO | 2008087281 | 7/2008 |

* cited by examiner

*Primary Examiner* — Brad Harcourt

(57) ABSTRACT

A method and an apparatus log an underbalanced open hole well without killing the well or causing formation damage to maintain well control during the process. The installation of the well logging equipment is accomplished while holding the underbalanced open hole at its optimal pressure, then conveying the logging string on a drill string into the open hole portion to total depth and logging while removing the logging string from the total depth to be logged with a cable side entry sub. The invention also provides a unique configuration of equipment to accomplish the logging using what is normally referred to as tough logging condition techniques.

16 Claims, 6 Drawing Sheets

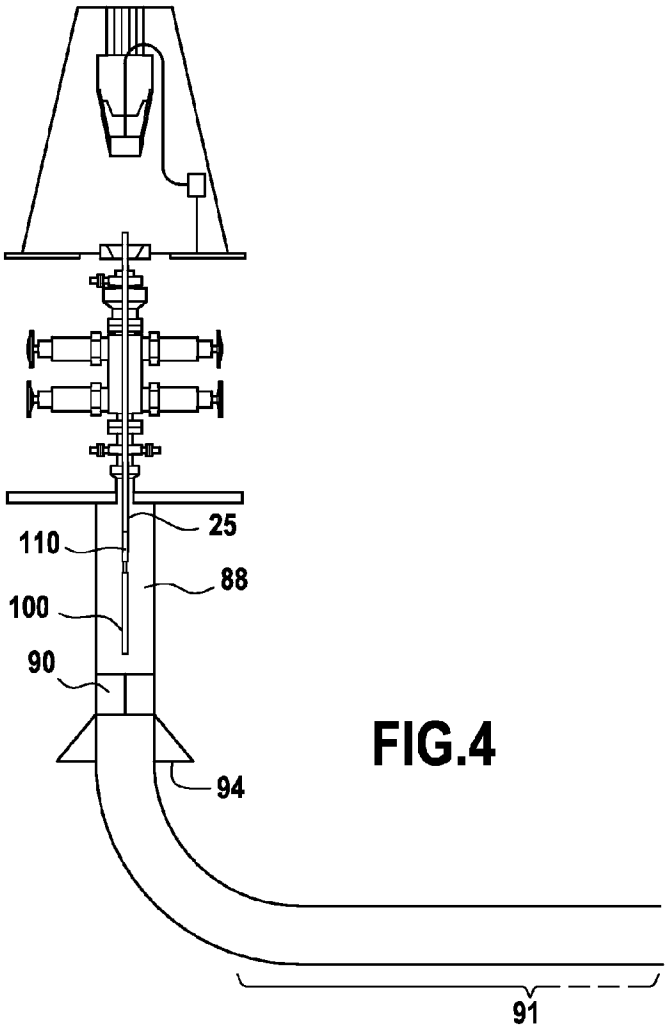
FIG.4
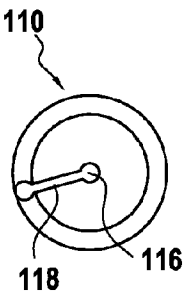
FIG.3B
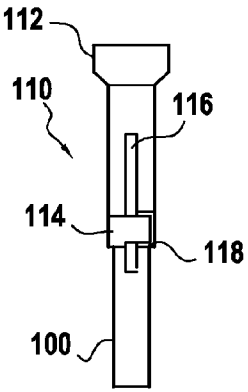
FIG.3A
FIG.3
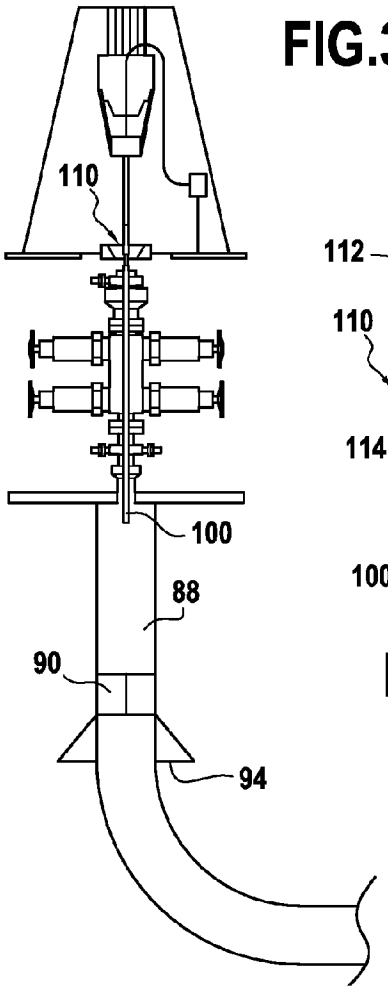

FIG.7
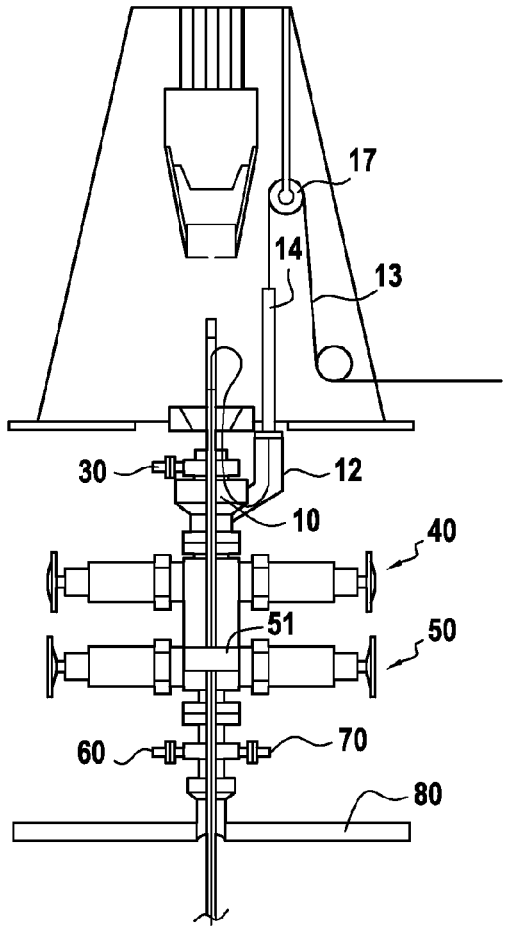
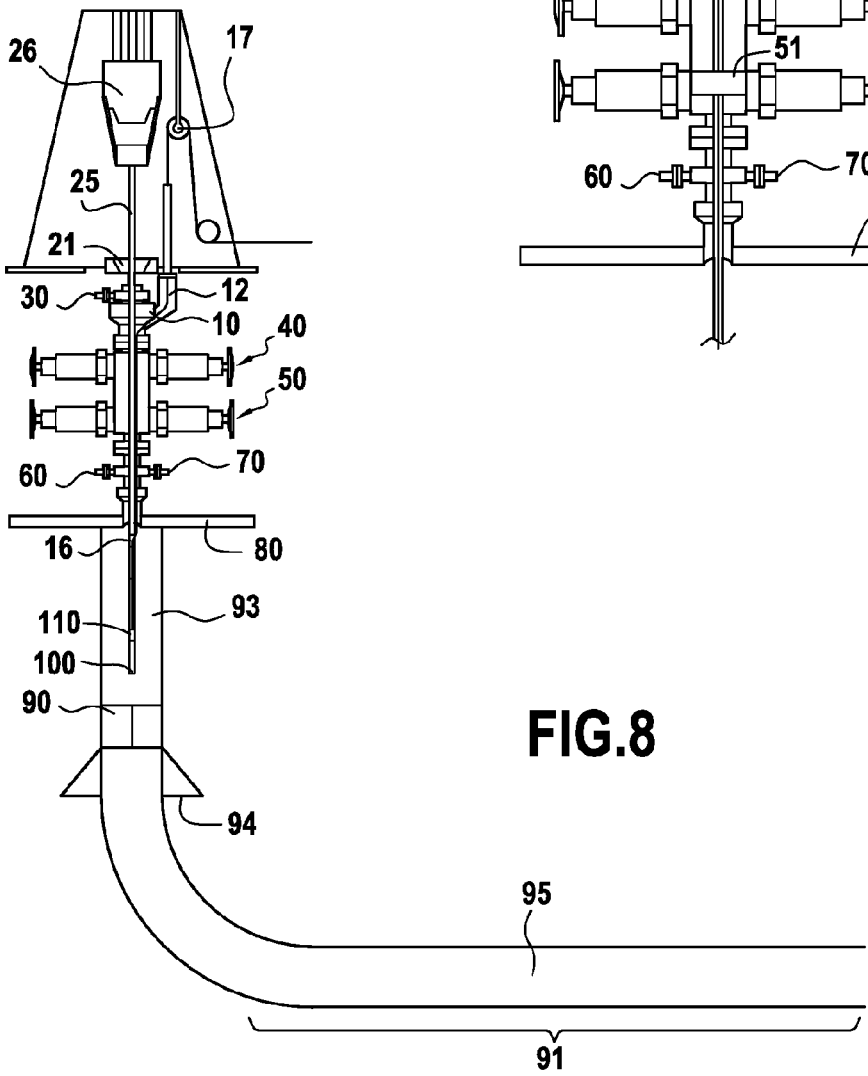
FIG.8

METHOD AND APPARATUS FOR PERFORMING WIRELINE LOGGING OPERATIONS IN AN UNDER-BALANCED WELL

INTRODUCTION

The invention relates to a well-logging technique and apparatus for accomplishing such logging without killing the well which has been horizontally drilled using under-balanced drilling techniques; more specifically, a process and apparatus for rigging up and completing wireline logging operations in a horizontal well which has been drilled using under-balanced drilling technique without killing the well by selectively introducing logging tools into an under-balanced well bore.

BACKGROUND OF INVENTION

Different techniques are being developed to circumvent the problem of sealing around the pipe and wireline cable for example, logging while drilling (LWD), memory shuttles conveyed by pumping them down inside pipe or using slim tools such as RST conveyed with cable inside drill pipe. So far as known to applicant, the problems with conveying a full suite of open hole logging tools in an under-balanced horizontal well remains unsolved.

Key benefits to pursue UBD include a high rate of penetration (ROP) within short radius horizontal drilling programs where up to 3-4 times reduction in drilling times have been reported. Although ROP has been a huge success, the potential of UBD to transform into a reservoir characterization and recovery technology has been masked by the limitations in current state of the art to perform advanced imaging services in an under-balanced well with a rotary blow out preventer (RBOP) stack at the surface necessary to accomplish UBD. This has forced some drilling companies and owners to insist that the well be killed between trips thus jeopardizing the benefits and increased productivity value of performing UBD. This technique will also enhance the impact of wireline logging, especially high-end technologies not available with logging while drilling programs (LWD), in horizontal under-balanced wells. This would permit development of combined formation evaluation and production evaluation programs for wireline services in the under-balanced horizontal drilling market.

The technique may also be useful in other situations where we may have a possibility to log using a jointed pipe in a workover well where either the well pressure is such that we could not convey by pumping the tools down or the trajectory of the well made it impossible for us to convey the tools using just gravity. In many cases, CT logging is considered as the only viable solution; however, this technique could be used with normal jointed pipe as a readily accessible solution not dependent on CT and its availability. This could improve wireline access to horizontal evaluation market.

The standard drilling practice is to maintain an overbalance pressure at all times acting on the formation while drilling which is intentionally kept above the formation pore pressure however below the formation fracture/failure pressure to prevent unwanted influx of fluids into the well bore and to prevent a catastrophic blow out. Due to the overbalance pressure, fluids as well as solids infiltrate and invade into the reservoir rocks where potential hydrocarbons will be produced from. This results in damaging the virgin reservoir rock and thereby reducing the productivity of the well.

Under-balanced drilling is a drilling methodology in which the hydrostatic and dynamic pressures of mud are purposively kept below the formation pore pressure while maintaining complete well control at surface thereby allowing the well to flow or produce while drilling proceeds while preventing risks arising out of handling pressure and hydrocarbons flow at surface. A well drilled under-balanced achieves better productivity as compared to a well drilled over-balanced provided that the under-balance is maintained at all times from drilling till final completion and production. Under-balanced drilling and completion is especially suited in depleted fields where the formation pressure has reduced considerably after years of production and it is either impossible to drill through due to mechanical failure of reservoir rocks or significant damage is caused due to massive invasion. Either problem can justify an investment in under-balanced drilling and completion techniques.

Horizontal wells are a commonly used technique in the industry. Horizontal wells enable a long interval of reservoir to be contacted in a single well thereby improving the productivity and enhancing reservoir recovery economics. Horizontal well logging techniques have also evolved. While drilling measurements allow accurate well placement, in certain types of reservoirs and depending on the evaluation objectives requested by the owner, there still remains a strong need to perform wireline logging operations involving high resolution imaging, magnetic resonance measurements, as well as downhole fluid analysis and sampling services—most of which are currently not available with LWD. For such cases, the industry has developed a method conveniently termed in current literature as "tough logging conditions" (TLC) which enables the tools to be conveyed on drill pipe while also maintaining an electrical connection to the surface unit using a standard wireline cable. The method, in summary, involves conveying tools in the well using drill pipe till just above the last casing shoe. A cable side door entry sub is then inserted in drill string to allow the cable to be rigged up and to enter inside the drill pipe through the side entry sub and further connect to the tools already down hole. The cable is tied up or fixed at the side entry sub and further both cable and drill pipe are simultaneously conveyed down to perform logging operations. A standard feature of a TLC system is that a certain length of cable, equal to the length of the logging interval as a minimum, ends up being outside the pipe located between the rig floor and down to point in the drill string where the cable enters the drill pipe i.e. the side entry sub.

Under-balanced drilling is especially suited for horizontal wells because formation damage in horizontal over-balanced wells can be very significant due to the long contact length and contact time between reservoir rocks and drilling fluids as well as constant scraping of filter cake by the drill pipe lying down on the low side of the horizontal. Therefore, significant productivity is lost due to formation damage in horizontal wells. The industry has therefore realized the need to design technologies that are able to perform under-balanced drilling in horizontal wells to lower the formation damage that would otherwise be caused if the well was drilled over-balanced and thereby achieve higher productivity.

Another advantage of performing UBD is that it allows productivity data to be obtained while the well is being drilled. In wells where $N_2$ injection is made to achieve under-balance, the accuracy of such productivity data is questionable due to the lack of measurements available along the entire length of drill pipe and fluctuations in the fluid density as well as flow contributions and pressures in the entire length of the open hole section. Various techniques such as "testing while under-balanced drilling" have been introduced however they rely on the accuracy of four-phase models to determine reservoir permeability and productivity. The accuracy of such models to determine the four-phase fluid behaviors and flow characteristics in a complex well trajectory is also very limited. Hence, productivity information obtained from under-balanced wells while drilling has a large margin of error; however, any information assists the operators determination, albeit with low accuracy, of the ultimate true potential of a well with no damage to the well.

In vertical wells, once UBD is finished, the well can be logged in an under-balanced state using conventional logging techniques utilizing surface pressure control systems rigged up through the standard rig blow out prevention stack to accurately determine the reservoir productivity. Supply of $N_2$, if required, can be provided by a parasitic string inserted for this specific purpose. However, in horizontal wells, the standard TLC technique as used in over-balanced drilling environment suffers from a serious limitation as a certain cable section must be kept outside of the drill pipe in length equal to the interval being logged, located between rig floor and down hole cable side entry sub which cannot be sealed around as the annular BOPs are not designed to seal around a pipe with a wire outside it and any attempt to do so could damage the cable and jeopardize the whole operation. This means that advanced services logging operations such as high resolution imaging, production logging measurements such as downhole flow rates, phase hold ups and zonal contributions from reservoir and others not available using LWD or memory option cannot be performed with standard surface set up which is a serious disadvantage for the exploration and production (E&P) operator. In some cases coil tubing with electric cable could be an option however the ability of coil tubing to push a heavy suite of open hole logging tools all the way to TD in a long horizontal open hole is a serious short coming, not to mention the added complexity, risk and investment needed to carry out such an operation. Without wireline log data, it is not possible for the E&P operators to accurately determine the ultimate true productivity potential of the well. It is also not possible to optimize completion design based on accurate productivity profiles. It is also not possible to improve the accuracy of while drilling productivity measurements. There is a need for a new system that would give E&P operators easy access to wireline technologies in horizontal under-balanced well construction.

The invention is designed to address all the short comings in current state of art of the logging during the under-balanced well construction process, thereby allowing operators to reap full benefits of investment in under-balanced drilling from increase ROP to enhanced characterization and increase recovery.

The main objective of this invention is therefore to provide apparatus and methods of using the apparatus to perform the equivalent of TLC logging operation in an under-balanced horizontal well in order to achieve the following benefits which are three fold:

1. Perform logging operations in an under-balanced horizontal well without killing it, thereby ensuring any higher well productivity benefits achievable due to reduced or no formation damage are not jeopardized. The well could be either just drilled or an old well that requires logging with rig on site.
2. Direct determination of reservoir characterization parameters such as flow, pressure, PI, sweet spots (permeable micro fractures) early in the process of well construction and with required accuracy in order to determine the Ultimate True Productivity Potential (UTPP) of an undamaged horizontal (or multi-lateral) well drilled using under-balanced drilling technique, thus enabling E&P operators to book additional reserves under a recoverable category.
3. Under-balanced well completion optimization, more specifically in a fractured reservoir, by optimal placement of zonal isolation materials/packers using well productivity profiles obtained early during well construction process as input.

SUMMARY OF INVENTION

A method for performing logging operations in an underbalanced horizontal well without killing the well requires providing a logging string comprising a tool section, connected to a downhole wet connector head; lowering the logging string to a position adjacent a closed pressure isolation valve on a drill pipe; inserting a wireline electrical cable through a cable side entry sub and connecting to a pump down wet connector head and connecting to the downhole wet connector head; adjusting annulus pressure and opening the pressure isolation valve; snubbing the logging string into the well bore to a bottom of the open hole while maintaining an underbalanced pressure in the well bore; and, logging the open hole of the underbalanced well bore.

Specifically, this method for performing logging operations in an underbalanced horizontal well without killing the well consists of the steps of installing a down hole wet connector head in a logging tool string; inserting the down hole wet connector head and tool string into a casing string deployed to a position adjacent a closed pressure isolation valve; installing a cable side door entry sub; inserting a wire line to a pump-down wireline connector through the cable side door entry sub and connecting the wire line; pumping the pump-down wireline connector to engage the downhole wet connector head; adjusting pressure between the underbalanced portion of the previously drilled well and the proximal portion of the drill string above the pressure isolation valve; and, opening the closed pressure isolation valve and moving the logging tool string to the total depth to log the well without killing the well.

This method can further provide for the step of testing the logging tool prior to lowering on the drill pipe to a position adjacent the closed pressure isolation valve.

A method for logging a deviated underbalanced well without killing the well comprises drilling to a planned total depth underbalanced with a drill string and bottom hole assembly. Once drilling is accomplished, the method foresees withdrawing the drill string and bottom hole assembly while maintaining the well bore underbalanced; closing a pressure isolation valve set at a distal end of a casing string and reducing pressure on the closed portion of the well bore. Thereafter, one must rig up a logging tool string providing a downhole wet connector head; attaching drill pipe to the logging tool string and lowering the logging string to a position adjacent the closed pressure isolation valve. Then, the operator would deploy a wireline electrical cable connected to a pump-down connector head from below a rotary blow out preventer through a cable side entry sub. This allows the movement of the wireline electrical cable from the wireline sheave all in a manner well known in this art. The operator would pump down the pump-down connector head to mate with the downhole wet connector head on the logging tool string to complete the electrical connection between the logging truck and the logging string. The electrical cable would be sufficiently slacked off to prevent premature separation from the well connector head and the cable would tied off to the cable side entry sub and packoff. Next, the operator would run the drill string and connected logging string into the well bore to position adjacent the pressure isolation valve and adjust pressure in the closed portion of the well bore with drilling mud and $N_2$ circulation to avoid shocking or killing the open hole portion of the underbalanced well upon opening the pressure isolation valve, again in a manner known to underbalanced drilling operators. Finally, the operator would open the pressure isolation valve and run in the drill pipe string and logging string to the total depth while maintaining safety of the well and ensuring well control by providing pressure seals around both cable and drill pipe; and, log the open hole deviated well upon withdrawal of the logging string, in a normal manner well known in the tough logging conditions arts.

The logging string in the present invention can be made up of any number of logging and well control devices which are currently not utilized in horizontal underbalanced wells and have no alternate available in LWD (logging while drilling); such as a Formation Micro-imager (FMI); an oil base mud micro imager (OBMI); an ultrasonic borehole imager (UBI); a Reservoir Saturation Tool (RST); a Flow Scan Imager (FSI) incorporating sensors such as pressure, temperature, fluid density, flow rate, water flow logs; a Modular Dynamics Tester (MDT); a Nuclear Magnetic Resonance (NMR) Scanner; a Sonic Scanner; a Resistivity Scanner; a side-wall coring tool (MSCT); or an elemental capture spectroscope (ECS). Using the present invention TLC in an underbalanced horizontal well for standard as well as advanced technologies logging can be readily accomplished.

The apparatus of the present invention is best suited for an arrangement where the drill pipe joints between the downhole wet connector head and the cable side entry sub are substantially equivalent in length to the formation to be logged, thus permitting the full reach of the logging string to be pushed to the logging depth required. Moving the tubing string deeper into the well exposes the wireline to the open well bore formation which can crush or damage the wireline.

This apparatus for logging an underbalanced well comprising: means for drilling to a planned total depth underbalanced with a drill string and bottom hole assembly; means for withdrawing the drill string and bottom hole assembly while maintaining the well bore underbalanced; means for closing a pressure isolation valve set at a distal end of a casing string and reducing pressure on the closed portion of the well bore; means for rigging up a logging tool string providing a downhole wet connector head; means for attaching drill pipe to the logging tool string and lowering the logging string to a position adjacent the closed pressure isolation valve; means for deploying a wireline electrical cable connected to a pump-down connector head from below a rotary blow out preventer through a cable side entry sub; means for pumping down down the pump-down connector head to mate with the downhole wet connector head on the logging tool string; means for tying off the electrical cable to the cable side entry sub and packoff; means for running the drill string and connected logging string into the well bore to adjacent the pressure isolation valve and pressuring the closed portion of the well bore to avoid shocking or killing the open hole portion of the underbalanced well upon opening the pressure isolation valve; means for opening the pressure isolation valve and running in the drill pipe string and logging string to the total depth; and, means for logging the open hole deviated well upon withdrawal of the logging string.

This invention is accomplished using a rotating blow out preventer providing a rotating rubber seal permitting rotation of a drill string under pressure while creating a sealed tubular connection; a wireline entry guide connected to the sealed side of the rotating blow out preventer; and, a wireline pressure control device connected to the wireline entry guide. The wireline entry guide can be hardfaced to limit the wear on the rotating blow out preventer from the movement of the wireline through the body. Moreover, the wireline entry apparatus can be fabricated wherein the wireline entry guide and the rotating blow out preventer comprise an integral body.

BRIEF DESCRIPTION OF THE DRAWINGS

FIG. 3 is a schematic view of the rigging of the logging toolstring in a well bore in preparation for logging the underbalanced well bore with a downhole wet connector attached at its proximal end.

FIG. 3A is a schematic side view of the downhole wet connector head which is deployed on the logging tool string reflecting that the electrical connection continues below the float valve.

FIG. 3B is a schematic top view of the deployment of the logging tool string into the well bore in preparation for connecting the wireline electrical connection to the logging string.

FIG. 4 is a schematic view of the moving the logging tool into the well bore prior to installation of the cable side door entry sub and the installation of the wireline cable into the logging string.

FIG. 7 is the surface schematic configuration of the fixing the wireline cable to the cable side entry sub at the rig floor after providing sufficient slack in the wireline to prevent premature unlatching during logging.

FIG. 8 is the schematic view of pressure adjustment in the casing string in preparation for opening the pressure isolation valve and going into the well to total depth.

DETAILED DESCRIPTION OF AN EMBODIMENT

The logging of deviated or horizontal wells using a drill string to set the logging tool string in place has been more fully described in U.S. Pat. No. 5,871,052, the contents of which are fully incorporated herein by reference as if copied herein verbatim. In the present inventive method, the logging tool string must be rigged up and lowered into the well bore while maintaining the underbalanced well bore at its underbalanced pressure but without killing the well by pumping in a mud column to contain the downhole pressure.

Figure 1:
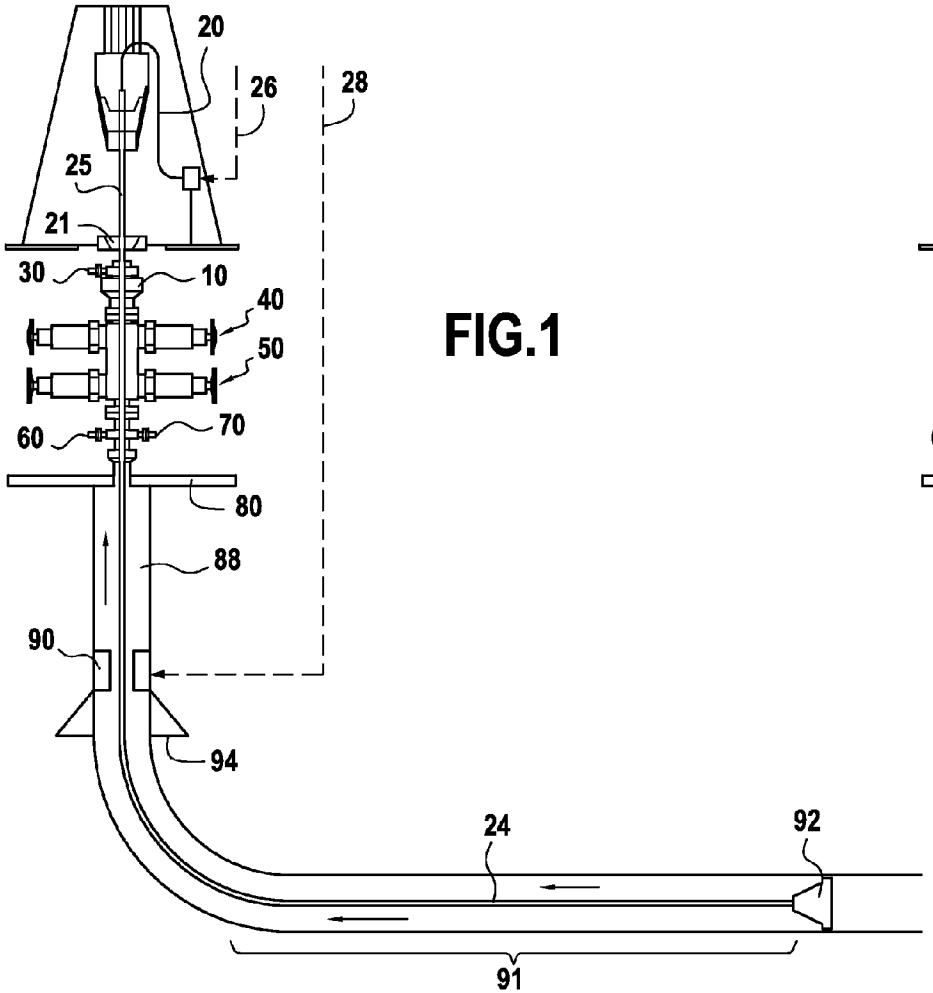
FIG. 1 is a schematic view of the surface equipment typically found in an underbalanced drilling operation.

As can be readily seen in FIG. 1, the principal issues for underbalanced drilling (UBD) is the maintenance of pressure at the surface while controlling the well from kicking or blowing out. Accordingly, the safety needs at the surface must be counterbalanced with the need to maintain only so much pressure on the well bore as is required to avoid contain the natural pore pressure within the well bore. Pressure is managed by an annular rotary blow-out preventer 10 which allows drill string 25 to be inserted or snubbed into the well bore (not shown) under pressure and permit rotation of the drill string by the rotary table 27. Mud line 20 can also be used to provide additional pressure control as needed. Mud return line 30 takes returning mud, produced fluids and gases to the separators and phase control devices normally associated with UBD. Blind rams 40 and shear rams 50 are typically placed in the blow out preventor stack to prevent accidental blowouts, all in a manner well known in the drilling art. Kill line 60 and choke line 70 complete the well head assembly for a typical underbalanced stack above the ground level 80. Nitrogen ($N_2$) can be added either through injection into the mud line 26 or by a parasitic line 28 into the casing annulus 88, both in a manner well known in this art. For example, a pressure isolation valve 90 can be disposed in the casing adjacent the casing shoe and which can selectively opened and closed to maintain pressure in the open hole portion 91 of the well bore. This pressure isolation valve 90 can be hydraulically actuated using a control line running from the surface, or alternatively battery powered with control signals sent to the valve by electric communication cable or pulse codes using fluid or electromagnetic signals, all of which can be found in existing technology in this art. Additional problems in underbalanced drilling offshore are not disclosed, but existing technology could be adapted using the disclosure contained herein to permit logging an offshore underbalanced well with the methods described herein without departing from the spirit or intent of this invention.

Figure 2:
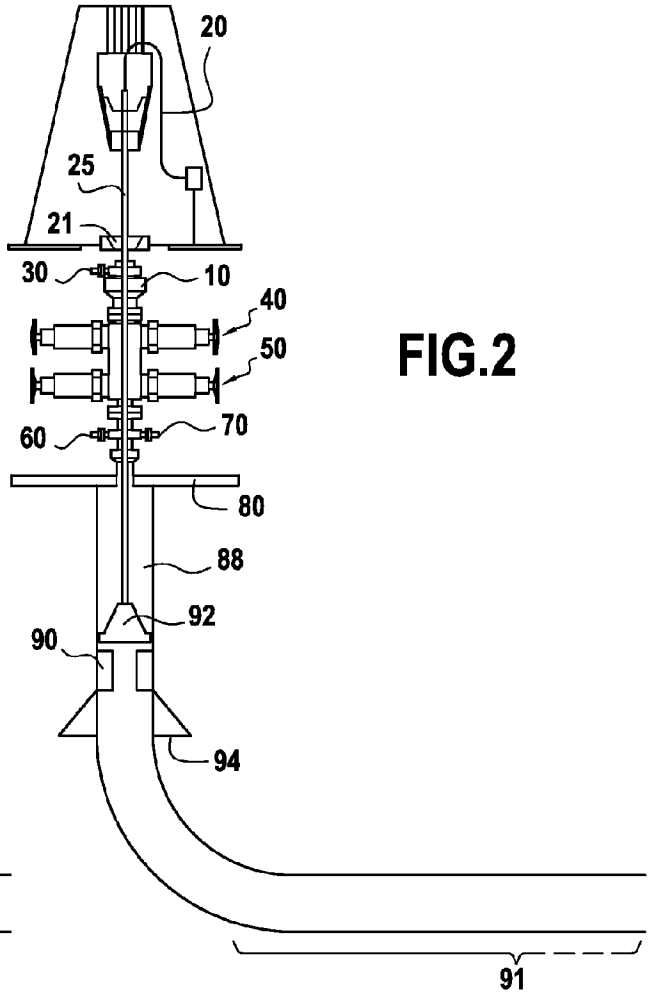
FIG. 2 is a schematic view of the underbalanced drilling operation tripping the bottom hole assembly past the pressure isolation valve and closing the PIV to maintain the underbalanced state of the open hole portion of the well bore.

FIG. 2 shows the stage of the deployment of the present invention after the drill bit 92 is withdrawn past the pressure isolation valve 90 when tripping out of the well bore. After the pressure isolation valve 90 (PIV) is closed, $N_2$ is stopped and pressure is bled off the upper portion of the casing string and the rotary blow out preventer is opened. Mud return 30 will reflect the decline in pressure and stop flowing after the pressure is bled off. Normal tripping of the drill string can be completed, making the well ready either for further drilling; or, the installation of the logging string into the open hole 91 of the well bore.

FIG. 3 discloses the rigging up of the logging string 100 which contain advanced logging operations such as high resolution imagining, production logging and other features not normally available using logging while drilling. These advance techniques allow the well owner to determine the true productivity potential of the well, among other reservoir characterization related benefits. This logging operation facilitated by this method permits the driller to optimize design of the well completion profile, not previously available, thereby increasing total recovery from the well. The logging string 100 required by the operator is inserted in the well bore 88 and connected at its proximal end with a downhole wet connector head (DWCH) 110, which provides a box end 112 (shown in FIG. 3A) for connection to a drill string. DWCH 110, as seen in the cross-sectional side view of FIG. 3A, also provides a float valve 114 which in this application acts like an internal blow out preventer (BOP) providing additional protection to the rig floor, while allowing circulation of mud and $N_2$ into the well bore. DWCH 110 further provides a male wet connector 116 for union with a pump down connector head, which provides a electrical connection 118 to the logging string attached to the DWCH, as may be readily seen in the cross-sectional view of FIG. 3B.

FIG. 4 discloses the next step in deploying the logging string into the underbalanced well bore. Logging string 100 is connected with the DWCH 110 having the box connection to drill pipe string 25 and lowered to a position adjacent the pressure isolation valve (PIV) 90 which remains in the closed position. The completion of this portion of the rigging up process sets the stage for the next phase of the operation.

Figure 5:
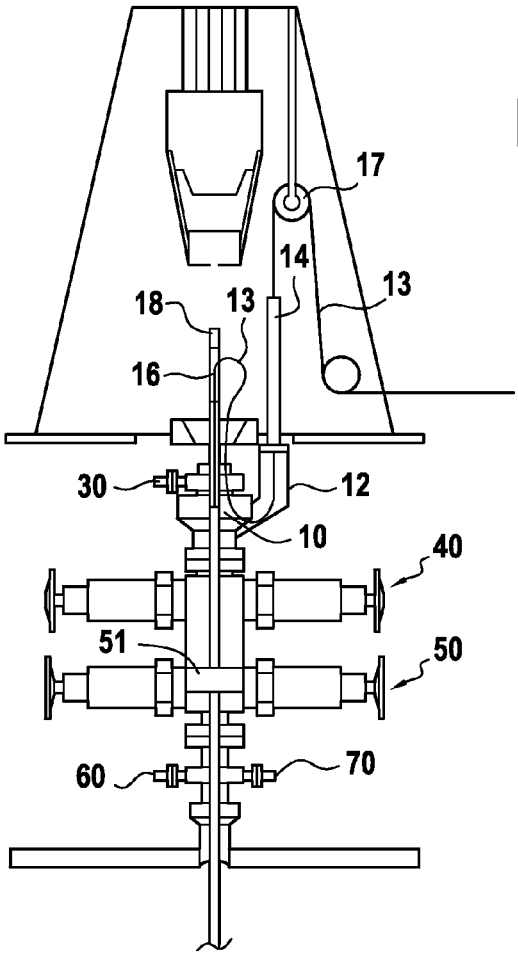
FIG. 5 is a schematic view of the process of rigging the cable side entry sub and installation of the wireline cable into the drill string in preparation for latching the pump down wireline connector head into the downhole wet connector head.

FIG. 5 shows the rigging up of the electrical wireline through a lubricator system 14 which connects at or below the rotary blow out preventer 10. Electrical wireline cable 13 is threaded through the sheave 17 into the lubricator 14, then up through the open rotary blow out preventer 10. The wireline cable 13 is then put into the drill pipe through a cable side entry sub 16. A pump down wet connector head (PWCH) is attached and a float valve 18 is placed to close the PWCH in the drill string. Rams 51 can be closed as a backup safety measure while this rigging up occurs.

Lubricator 14 can provide a wireline packoff and wireline blow out preventer to seal against pressure and pressure surges experienced by the well while logging takes place. The entry point for the wireline cable is below the rams in the rotary blow out preventer and can be formed from a Y-connection or fabricated into a rotary blow out preventer body. Once the float valve 18 is attached to the top of the cable side entry sub 16, additional drill pipe can be connected into the drill string assembly, pipe rams can be opened and the float valve/cable side entry sub moved below the rotary blow out preventer. Pressure control is thus maintained over the drill string through the mud line and the casing string below and over wireline through the Lubricator 14. The pump down wireline connect head is sent down either by gravity or slight pump pressure to mate with the downhole wet connect head attached to the logging string.

Figure 6:
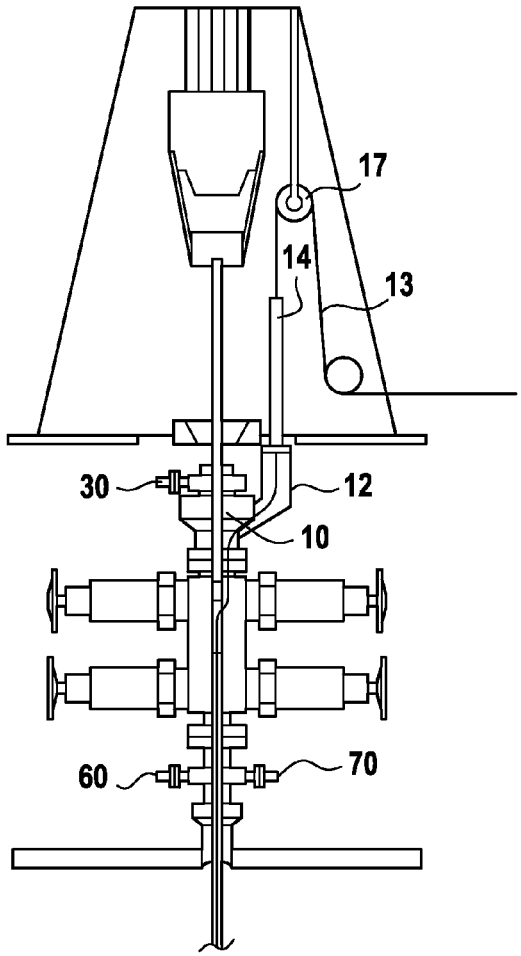
FIG. 6 is the surface configuration as the pump down wireline connector head is connected to the downhole wet connector head.

FIG. 6 shows the surface configuration as the PWCH is connected to the DWCH.

Once the connection between the PWCH and the DWCH is made and tested, the electrical wireline cable is slacked off sufficiently into the drill string to prevent premature connector separation. The operator would then pull the drill string up to the rig floor as shown in FIG. 7 and the cable would be affixed by banding or other means well known to those in this art to the cable side entry sub.

Then, as shown in FIG. 8, the drill string 25 is lengthened by adding additional drill pipe sections and the logging assembly is moved to its position adjacent the pressure isolation valve PIV 90 which has remained closed while introducing additional cable length into well bore. Mud and $N_2$ are added to the casing annulus 93 to bring the pressure to approximate the open hole pressure 95 to avoid shocking the well or killing the well, that is, to match the downhole formation pressure in the underbalanced portion of the well. At this point, the PIV would be opened and the logging string would be moved by manipulation of the drillstring 25 into the well bore to total depth and simultaneous and coordinated insertion of additional cable length.

It is generally expected that the distance from the downhole wet connector head to the side entry sub will be long enough to protect the wireline cable which is run inside the drill string from the side entry sub to the wet connect to completely log the open hole portion 91 of the well bore. This will protect the wireline from damage from formation collapse or scuffing as it runs in the horizontal portion of the well below the casing shoe 94, outside of the casing.

Figure 9:
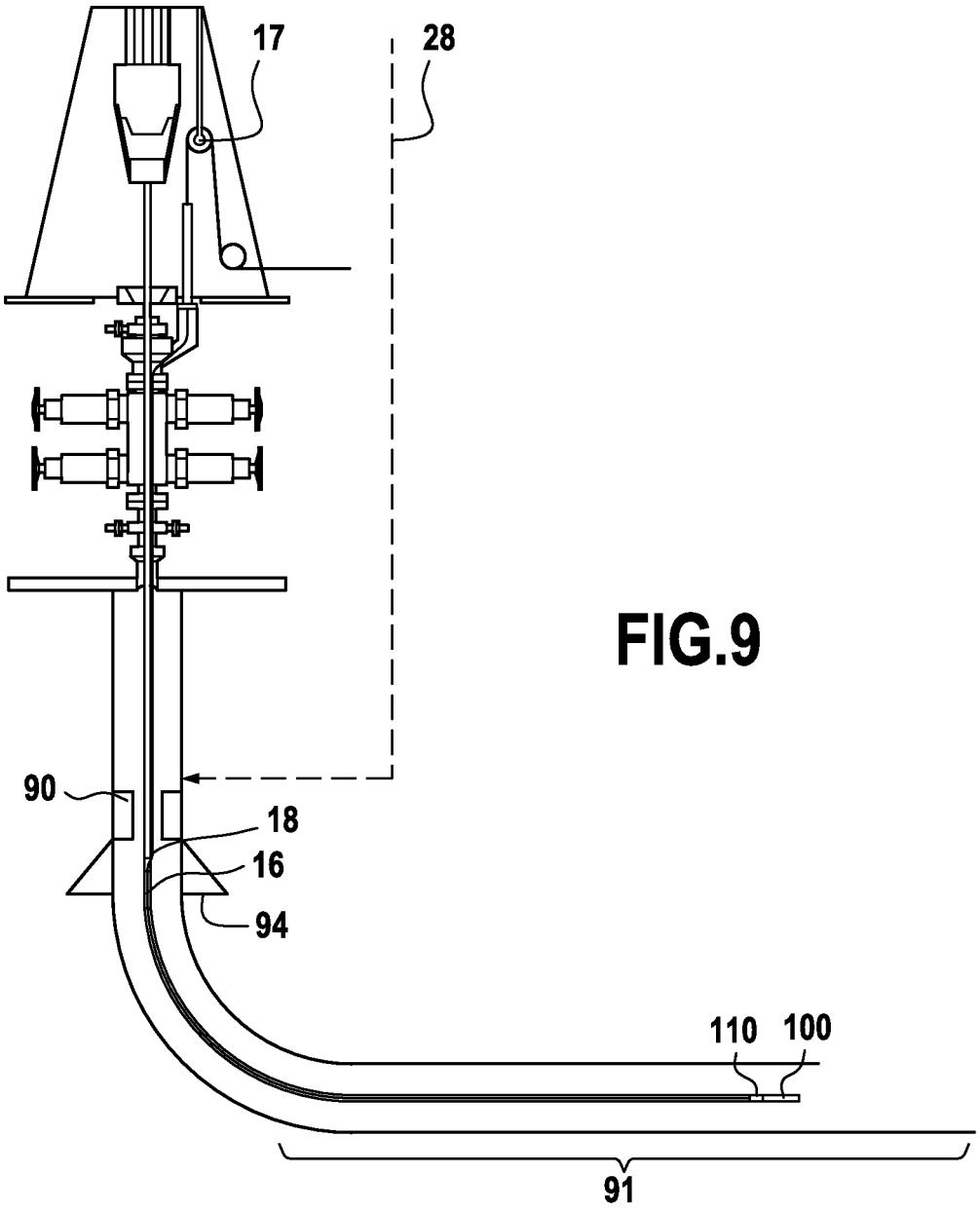
FIG. 9 is a schematic view of the completed assembly being run into the well bore to total depth in preparation for pulling the logging string back out of the well bore to log the open hole portion of the well.

As may be readily appreciated in FIG. 9, the wireline cabling runs on the exterior of the drill string until it enters the drill string at the cable side entry sub CSES. Once the required bottom logging interval depth is experienced by the logging string 100, the operator withdraws the drill string in coordination with the wireline operator to move the logging string through the open hole portion 91 of the well bore to accurately log the well in its underbalanced condition.

Figure 10:
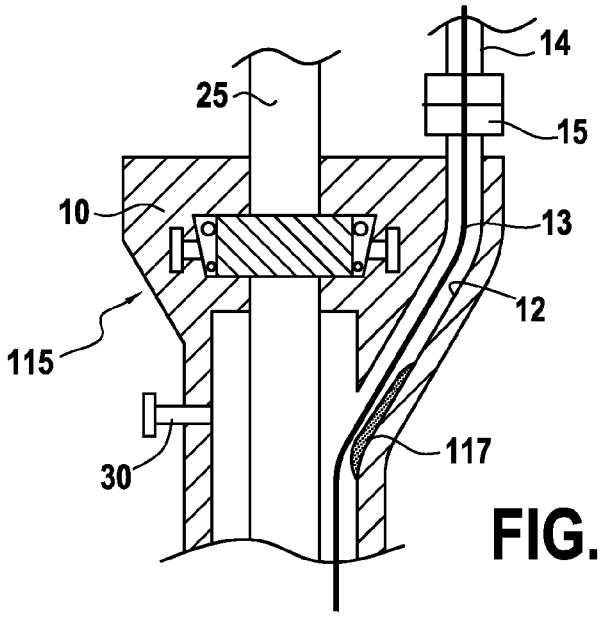
FIG. 10 is a schematic view of the integral bodied rotating blow out preventer and wireline entry guide of the present invention.

To accomplish the foregoing invention, the wireline must be inserted below the rotating blow out preventer rams or packer seal. FIG. 10 shows an embodiment of a preferred embodiment of the wireline entry guide 12 fabricated in a rotating blow out preventer body 10, providing hydraulic actuation and rotating members 115 well known in this art. The wireline guide 12 supports lubricator 14 to admit the wireline 13 through standard wireline pressure control devices or packoffs (not shown). The opening to drill pipe 25 is pressure controlled by the hydraulically actuated rubber members 115, all in a manner well known in this industry. Hardfacing 117 can be fabricated on the wireline contact surface to prevent sawing or gouging of the body of the rotating blow out preventer.

Figure 11:
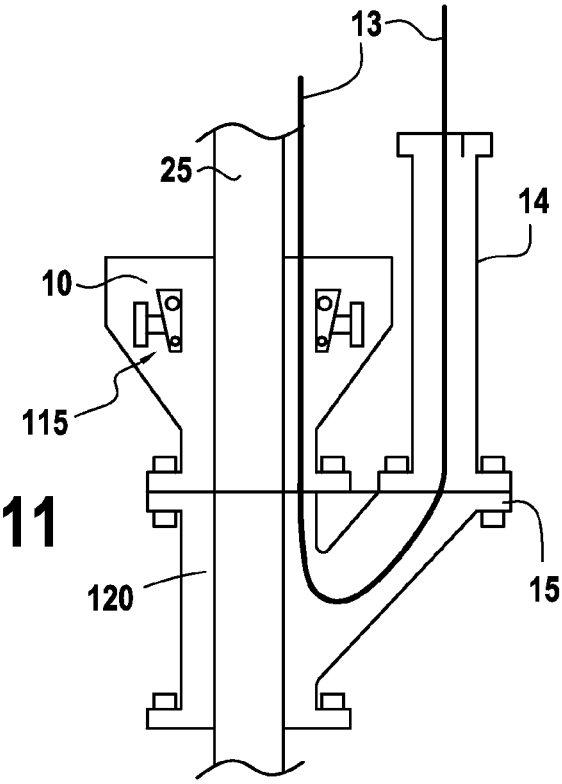
FIG. 11 is a schematic view of the wireline entry guide deployed below the rotating blow out preventer.

FIG. 11 shows an alternative embodiment of the present invention wherein the wireline entry guide body 120 is bolted to the rotating blow out preventer body 10. In this view, the rams or packer sealing element of the rotating body have been opened to allow the wireline 13 to be threaded back to the rig floor, as earlier described, for attachment to the pump down wet connect head (PWCH), as shown in FIG. 5. Once attached, the drill string 25 is again lowered below the rams 115 of the rotating blow out preventer, then pressure is again reestablished and controlled in the annulus to pump down the PWCH to connect to the previously deployed downhole wet connect head (DWCH), to complete the logging the open hole underbalanced well described above. Lubricator 14 of FIG. 11 similarly provides wireline pressure control devices or packoffs which seal around the wireline 13 to prevent blow outs through the wireline entry port, all in a manner well known in the drilling industry.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

The invention claimed is:

1. A method for performing logging operations in an underbalanced horizontal well without killing the well comprising:
- providing a logging string comprising a tool section, connected to a downhole wet connector head;
- lowering the logging string to a position adjacent a closed pressure isolation valve on a drill pipe;
- inserting a wireline electrical cable through a cable side entry sub and connecting to a pump down wet connector head and connecting to the downhole wet connector head;
- adjusting annulus pressure and opening the pressure isolation valve;
- snubbing the logging string into the well bore to a bottom of the open hole while maintaining an underbalanced pressure in the well bore;
- and logging the open hole of the underbalanced well bore.

2. A method for performing logging operations in an underbalanced horizontal well without killing the well comprising:
- installing a down hole wet connector head in a logging tool string;
- inserting the down hole wet connector head and tool string into a casing string deployed to a position adjacent a closed down hole deployment valve;
- installing a cable side door entry sub;
- inserting a wire line to a pump-down wireline connector through the cable side door entry sub and connecting the wire line;
- pumping the pump-down wireline connector to engage the downhole wet connector head;
- adjusting pressure between the underbalanced portion of the previously drilled well and the proximal portion of the drill string above the pressure isolation valve;
- and opening the closed pressure isolation valve and moving the logging tool string to the total depth to log the well without killing the well.

3. The method of claim 2, further comprising the step of testing the logging tool prior to lowering on the drill pipe to a position adjacent the closed pressure isolation valve.

4. A method for logging a deviated underbalanced well without killing the well comprising:
- drilling to a planned total depth underbalanced with a drill string and bottom hole assembly;
- withdrawing the drill string and bottom hole assembly while maintaining the well bore underbalanced;
- closing a pressure isolation valve set at a distal end of a casing string and reducing pressure on the closed portion of the well bore;
- rigging up a logging tool string providing a downhole wet connector head;
- attaching drill pipe to the logging tool string and lowering the logging string to a position adjacent the closed pressure isolation valve;
- deploying a wireline electrical cable connected to a pump-down connector head from below a rotary blow out preventer through a cable side entry sub;
- pumping down the pump-down connector head to mate with the downhole wet connector head on the logging tool string;
- tying off the electrical cable to the cable side entry sub and packoff;
- running the drill string and connected logging string into the well bore to adjacent the pressure isolation valve and pressuring the closed portion of the well bore to avoid shocking or killing the open hole portion of the underbalanced well upon opening the pressure isolation valve;
- opening the pressure isolation valve and running in the drill pipe string and logging string to the total depth; and logging the open hole deviated well upon withdrawal of the logging string.

5. An apparatus comprising:
- a blow out preventer comprising rams or a packer seal;
- a wireline electrical cable entering through the blow out preventer below the rams or the packer seal of the blow out preventer;
- a pump down wet connector head connected to the wireline electrical cable;
- a downhole wet connector head connected to the pump down wet connector head;
- a logging string connected to a distal end of the downhole wet connector head;
- a drill string of one or more drill pipe joints connected to a proximal end of the downhole wet connector head; and wherein the downhole wet connector head comprises a float valve.

6. The apparatus of claim 5, wherein the drill string of one or more drill pipe joints is connected to a cable side entry sub.

7. The apparatus of claim 6, wherein the drill pipe joints between the downhole wet connector head and the cable side entry sub are substantially equivalent in length to a formation to be logged.

8. The apparatus of claim 6, wherein the logging string comprises one or more of the logging tools selected from the following list: a Formation Micro-imager; an oil base mud micro imager; an ultrasonic borehole imager; a Reservoir Saturation Tool; a Flow Scan Imager incorporating sensors such as pressure, temperature, fluid density; flow rate, water flow logs; a Modular Dynamics Tester; A Nuclear Magnetic Resonance Scanner; a Sonic Scanner; a Resistivity Scanner; or a side-wall coring tool; an elemental capture spectroscope.

9. The apparatus of claim 6 wherein the cable side entry sub and the blow out preventer comprise an integral body.

10. An apparatus for logging an underbalanced well comprising:

means for drilling to a planned total depth underbalanced with a drill string and bottom hole assembly;

means for withdrawing the drill string and bottom hole assembly while maintaining the well bore underbalanced;

means for closing a pressure isolation valve set at a distal end of a casing string and reducing pressure on the closed portion of the well bore;

means for rigging up a logging tool string providing a downhole wet connector head;

means for attaching drill pipe to the logging tool string and lowering the logging string to a position adjacent the closed pressure isolation valve;

means for deploying a wireline electrical cable connected to a pump-down connector head from below a rotary blow out preventer through a cable side entry sub;

means for pumping down the pump-down connector head to mate with the downhole wet connector head on the logging tool string;

means for tying off the electrical cable to the cable side entry sub and packoff;

means for running the drill string and connected logging string into the well bore to adjacent the pressure isolation valve and pressuring the closed portion of the well bore to avoid shocking or killing the open hole portion of the underbalanced well upon opening the pressure isolation valve;

means for opening the pressure isolation valve and running in the drill pipe string and logging string to the total depth;

and means for logging the open hole deviated well upon withdrawal of the logging string.

11. An apparatus comprising:

a blow out preventer comprising rams or a packer seal;

a wireline entry guide connected to the blow out preventer below the rams or the packer seal of the blow out preventer;

wherein the blow out preventer further comprises a rotating blow out preventer providing a rotating rubber seal permitting rotation of a drill string under pressure while creating a sealed tubular connection, wherein a downhole wet connector head is connected at a proximal end to the drill string, and at a distal end to a logging string; and wherein the downhole wet connector head comprises a float valve.

12. The wireline entry apparatus of claim 11, wherein the wireline entry guide is hardfaced.

13. The apparatus of claim 11, wherein the wireline entry guide and the blow out preventer are integral.

14. The apparatus of claim 11, wherein a wireline pressure control device is connected to the wireline entry guide.

15. The apparatus of claim 11, wherein the logging string comprises one or more of the logging tools selected from the following list: a Formation Micro-imager; an oil base mud micro imager; an ultrasonic borehole imager; a Reservoir Saturation Tool; a Flow Scan Imager incorporating sensors such as pressure, temperature, fluid density; flow rate, water flow logs; a Modular Dynamics Tester; A Nuclear Magnetic Resonance Scanner; a Sonic Scanner; a Resistivity Scanner; or a side-wall coring tool; an element capture spectroscope.

16. The apparatus of claim 11, wherein the downhole wet connector head is connected to a pump down connector head.

* * * * *